US008155368B2

(12) United States Patent
Cheung et al.

(10) Patent No.: US 8,155,368 B2
(45) Date of Patent: Apr. 10, 2012

(54) SHOULDER/NECK SUPPORTING ELECTRONIC APPLICATION

(76) Inventors: George Cheung, Norwalk, CA (US); Peter Lee, Norwalk, CA (US); Paul Lau, Kowloon (HK); June Lee, Kowloon (HK)

( * ) Notice: Subject to any disclaimer, the term of this patent is extended or adjusted under 35 U.S.C. 154(b) by 979 days.

(21) Appl. No.: 12/150,858

(22) Filed: Apr. 30, 2008

(65) Prior Publication Data

US 2009/0274335 A1 Nov. 5, 2009

(51) Int. Cl.
*H04R 25/00* (2006.01)

(52) U.S. Cl. ..... 381/374; 381/370; 381/385; 381/390; 455/575.1; 455/575.2; 379/430

(58) Field of Classification Search ..... 381/370, 381/374, 385, 390; 455/575.1, 575.2; 379/430
See application file for complete search history.

(56) References Cited

U.S. PATENT DOCUMENTS 3,792,754 A * 2/1974 Hanson ..... 181/130
4,797,934 A * 1/1989 Hufnagel ..... 381/388
4,991,222 A * 2/1991 Nixdorf ..... 381/388
5,313,678 A * 5/1994 Redewill ..... 5/639
5,370,446 A * 12/1994 Bancod ..... 297/408
5,684,879 A * 11/1997 Verdick ..... 381/300
6,090,832 A * 7/2000 Bialosky et al. ..... 514/365
6,289,538 B1 * 9/2001 Fidge ..... 5/640
7,162,048 B2 * 1/2007 Shima ..... 381/334
7,570,977 B2 * 8/2009 Gantz et al. ..... 455/575.2
7,571,503 B2 * 8/2009 Gabriel ..... 5/636
7,783,065 B2 * 8/2010 Navid ..... 381/311
7,978,870 B2 * 7/2011 Cozens et al. ..... 381/371
8,009,847 B2 * 8/2011 Planansky ..... 381/301
8,009,853 B2 * 8/2011 Ito et al. ..... 381/381
2005/0212479 A1 * 9/2005 Tsunoda ..... 320/114
2007/0053544 A1 * 3/2007 Jhao et al. ..... 381/384
2008/0019552 A1 * 1/2008 Eldracher ..... 381/374

FOREIGN PATENT DOCUMENTS

WO WO 02065809 A1 * 8/2002

* cited by examiner

*Primary Examiner* — Elvin G Enad
*Assistant Examiner* — Joselito Baisa
(74) *Attorney, Agent, or Firm* — Raymond Y. Chan; David and Raymond Patent Firm

(57) ABSTRACT

A shoulder/neck supporting electronic appliance includes a wireless head set wherein the head set includes a supporting unit adapted for wearing on a user's collar from behind, a wireless audio device comprising a wireless transceiver supported by the supporting unit for receiving an audio signal, and a power source electrically coupled with the wireless transceiver; and a headphone member provided at the supporting unit in vicinity of the user's ear, such that an overall weight of the wireless head set is adapted for being supported and distributed on the collar of the user to minimize stress on the user's head when the user's wears the wireless head set.

17 Claims, 11 Drawing Sheets

TV Listener Transmitter Block Diagram

TV Listener Receiver Block Diagram

SHOULDER/NECK SUPPORTING ELECTRONIC APPLICATION

BACKGROUND OF THE PRESENT INVENTION

1. Field of Invention

The present invention relates to an audio communication head set, and more particularly to an audio communication head set that provides a wireless transmission of audio signals from audio systems to a user, wherein the user is able to wear the audio communication head set that allows free movements of the user's head and neck, as well as free movement around an area where reception of audio signal is possible.

2. Description of Related Arts

Head sets has long been used by people from all aspects for listening to audio sounds at home when they watch television, movies, listen to the radios and recordings of musical works and outdoors when they carry around their walkmans, portable CD players, MD players M3 players and so forth.

Since they are so widely accepted by the consumers almost to a point where many people would have not just one but a few of them, manufacturers have always been working on advances of such products. The simplest form is simple ear phones provided for placing inside a user's ear, wherein the ear phones are fixed at the end of a wire that connect and transmit audio signal from an audio device to a user.

Some are more complicated where the amplifiers would be held besides the user's ear by a flexible head frame, where the wires would be hidden in a head frame, and the head set would also have control units arranged thereon for controlling the audio device, such that the user can control the audio device without reaching the audio device. A classic example is that when a user listens to a portable CD player and places the CD players inside his carrying bag, the user can change the track, increase or decrease the volume of the CD player without having to pull the CD player out from his carrying bag.

Such head sets are more popular than the simple ear phone types since they usually provides better sound quality and fits more comfortably on a user. Also, they do not fall off from a user's ear as easily as the simple ear phone types.

Currently, available in the market are two typical types of such head sets. The first one is the ones that have two amplifiers attached to a head frame, which is to be fixed on a user's head and holding the two amplifiers in place at the exteriors of the user's ears. The head sets are usually connected to the audio system through a wire.

Such head sets are usually heavy, big and rigid such that they either fits too tightly or too loosely on a user since everybody's head is of a different size. Many a time, when the head frame fits too tightly on the user, it would create too much stress on the user, causing the user discomfort which may also give the user physical headaches.

The other type, instead of placing the amplifiers next to the user's ears through a head frame, placing a neck ring with a controlling device arranged thereon, and a pair of ear phones are connects the neck ring to the user's ear to transmit the audio signals.

Despite its wireless nature and its convenience in controlling the audio system, this type of head sets, first, did not overcome the drawbacks of the simple ear phones where they would easily fall out of place of the user's ear. Second, many people may not like the idea of wearing a neck ring on their necks. Some people may find it very uncomfortable.

Both types of head set, as well as the simple ear phones, cannot achieve the objectives of providing a user with a convenient, comfortable and adjustable audio communication head set.

As a result, in order to provide consumers with a convenient, comfortable and adjustable audio communication head set, as well as to allow wireless communication of the audio system to the user, a better mode of audio communication head set must be provided, such that a user can more comfortably enjoy their audio experience, whether it is at home or when they are on the road.

SUMMARY OF THE PRESENT INVENTION

A main object of the present invention is to provide a shoulder/neck supporting electronic appliance which comprises a supporting unit having a curvature and a pair of headphone members foldably extend from the supporting unit to the user's ear, wherein the supporting unit is provided for holding the amplifiers at an exterior of the user's ears and resting the head set comfortably on a collar bone area of a user.

Another object of the present invention is to provide a shoulder/neck supporting electronic appliance, wherein a wireless audio device is provided for wirelessly receiving an audio signal from an entertainment system, such as a TV, a radio, a CD player and so forth.

Another object of the present invention is to provide a shoulder/neck supporting electronic appliance, wherein the supporting unit is flexible, such that when the head of the user rotates, the supporting unit adjusts its size according to the head movement of the user.

Another object of the present invention is to provide a shoulder/neck supporting electronic appliance, wherein a pair of flexible joints connects the headphone members to the supporting unit respectively in such a manner that the headphone member is adjusted automatically according to the head and neck movement of the user.

Another object of the present invention is to provide a shoulder/neck supporting electronic appliance, wherein each of the headphone members unfolds into an operation position forming an operation angle with the supporting when being used by the user and folds into a storing position aligning with the supporting unit when not being used by the user, such that the head set rests on the collar bone area of the user comfortably.

Another object of the present invention is to provide a shoulder/neck supporting electronic appliance, wherein the operation angle is adjustable according to the preference of the user, so as to provide comfort to the user.

Another object of the present invention is to provide a shoulder/neck supporting electronic appliance, wherein the headphone members are extendable, such that the headphone members can be adjusted to contact the ears of different users.

Another object of the present invention is to provide a shoulder/neck supporting electronic appliance, wherein the supporting unit is also extendable, such that the supporting unit can be extended sideways, to accommodate users of different neck sizes.

Another object of the present invention is to provide a shoulder/neck supporting electronic appliance, wherein the supporting unit is made of a flexible and bendable material, such that head set is durable and adjustable.

Another object of the present invention is to provide a shoulder/neck supporting electronic appliance, further comprises a control unit provided for controlling properties of the head set, and also the actions and properties of the entertainment system and the audio system, so as to provide the user with a higher degree of freedom.

Another object of the present invention is to provide a shoulder/neck supporting electronic appliance, further comprises a microphone, provided for an entertainment system or an audio system which has a voice recognizable device, wherein the user can use his voice to control the entertainment system and the audio system.

Accordingly, in order to accomplish the above objects, the present invention provides a shoulder/neck supporting electronic appliance, comprising a wireless head set which comprises:

a supporting unit adapted for wearing on a user's collar from behind;

a wireless audio device comprising a wireless transceiver supported by the supporting unit for receiving an audio signal, and a power source electrically coupled with the wireless transceiver; and a headphone member provided at the supporting unit in vicinity of the user's ear, such that an overall weight of the wireless head set is adapted for being supported and distributed on the collar of the user to minimize stress on the user's head when the user's wears the wireless head set.

These and other objectives, features, and advantages of the present invention will become apparent from the following detailed description, the accompanying drawings, and the appended claims.

DETAILED DESCRIPTION OF THE PREFERRED EMBODIMENT

Figure 1:
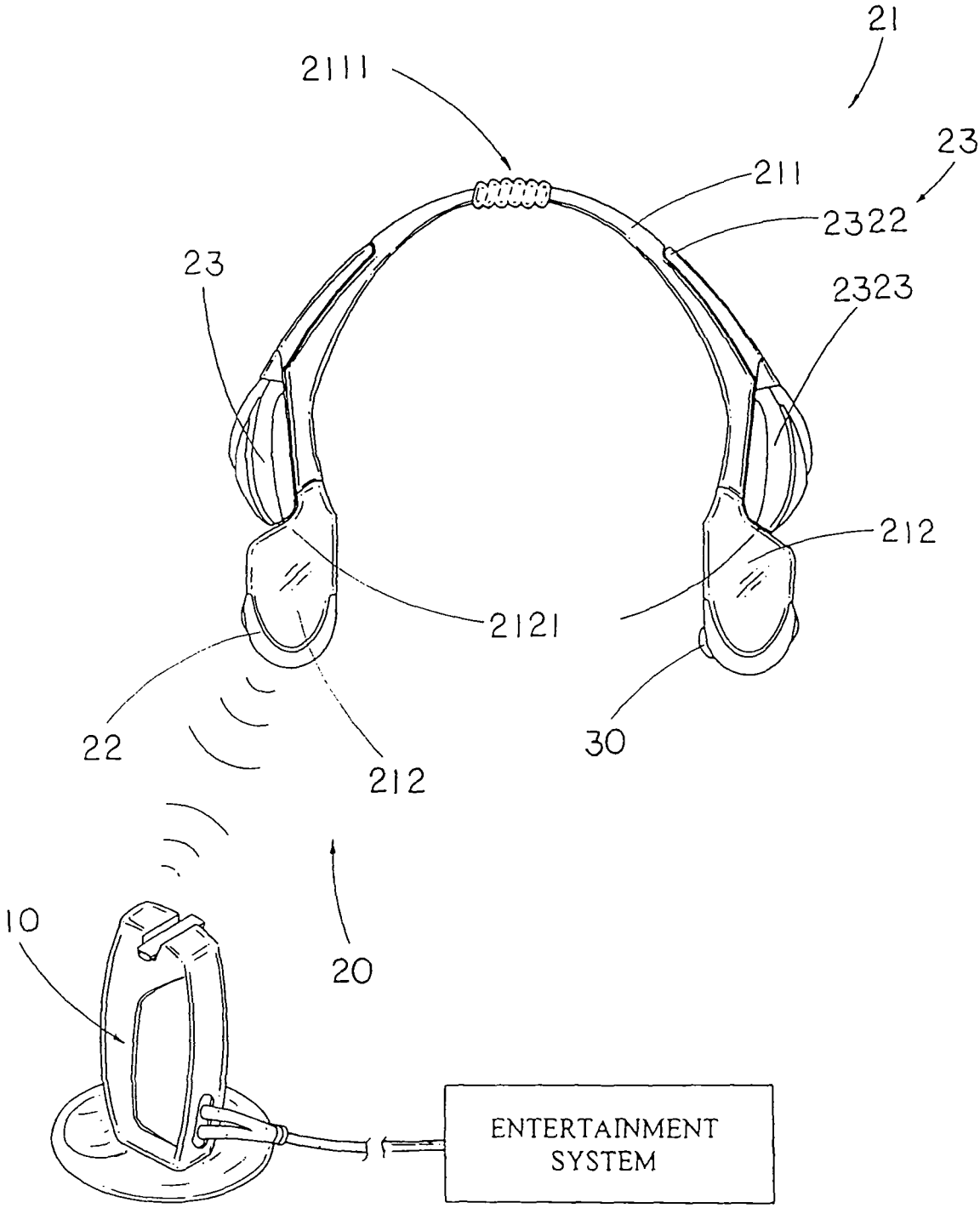
FIG. 1 illustrates an audio communication head set according to the preferred embodiment of the present invention.
Figure 2:
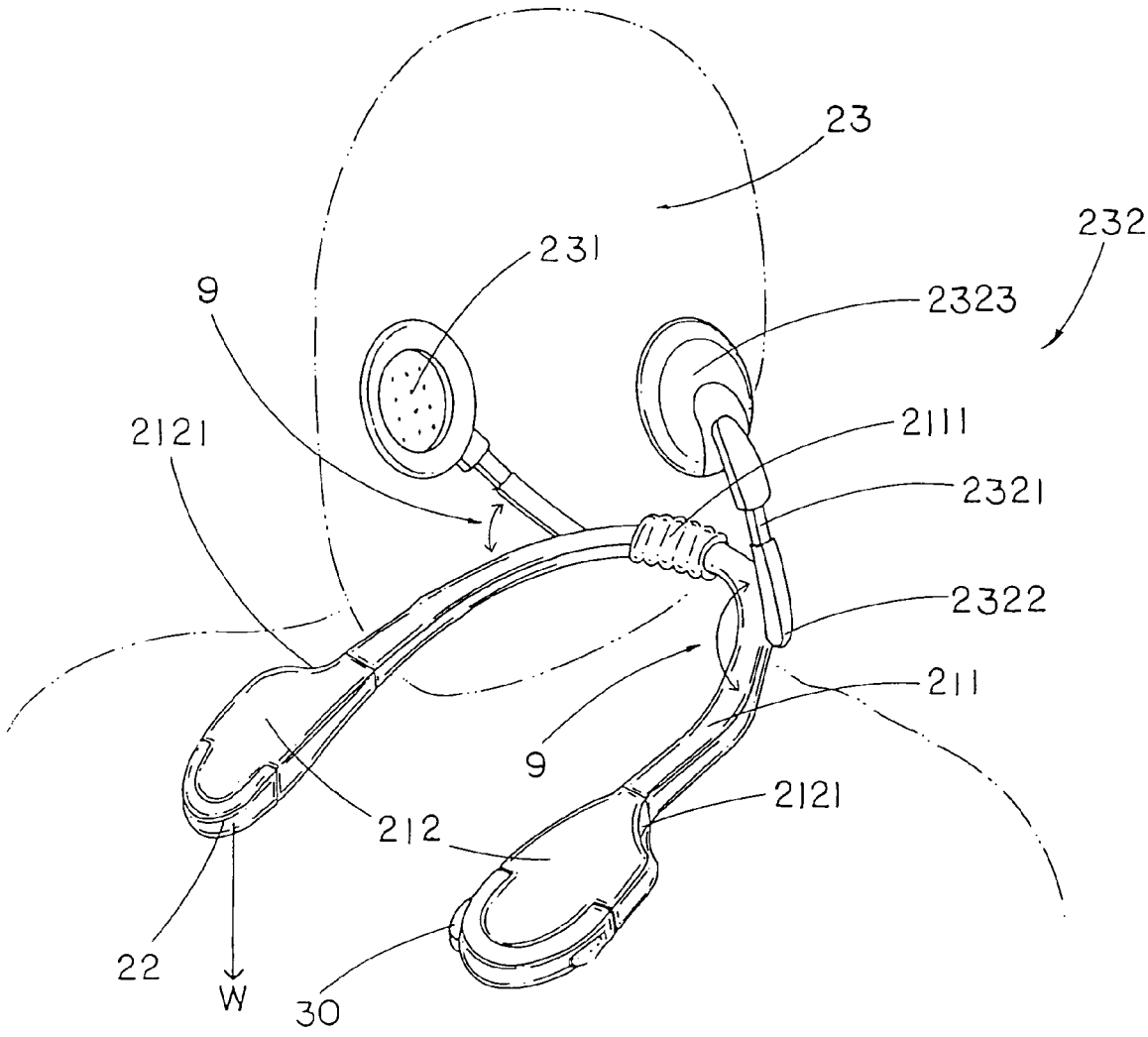
FIG. 2 is a side view of the audio communication head set according to the above preferred embodiment of the present invention.

Referring to FIG. 1 and FIG. 2 of the drawings, an audio communication head set for an entertainment system according to a preferred embodiment of the present invention is illustrated, wherein the audio communication head set comprises a wireless transmitter 10, and a wireless head set 20.

The wireless transmitter 10 is adapted for connecting with the entertainment system so as to transmit an audio signal from the entertainment system and the wireless head set 20 comprises a supporting unit 21, a wireless receiving device 22, and two headphone members 23.

The supporting unit 21 comprises a C-shaped collar-retention frame 211 and two stabilizing rests 212. The C-shaped collar-retention frame 211 has an adjustable curvature 2111 and is adapted for wearing on a user's collar from behind, while the two stabilizing rests 212 is provided at two ends of the collar-retention frame 211 respectively, for resting on the user's body to substantially stabilize the collar-retention frame 211 in position.

The adjustable curvature 2111 of the collar-retention frame 211, having a similar curvature to an average human neck, which enables the supporting unit 21 to fit on to users with different body build, such that the same audio communication head set can be applied on different users, which would minimize production cost since no different sizes is required to be manufactured.

The collar-retention frame 211 is provided for fitting around the neck area of the user and resting upon a collar bone area of a user, such that the collar-retention frame 211 does not post excess restrain on the user's neck since many people do not welcome the idea of having restrains on their neck because not only will they feel uncomfortable, they might even have a phobia of things being put round their necks. Discomfort cost by things placing round the neck of the user is most noticeable in summer time when many users will be sweating quite a lot due to the hot weather.

In order for the stabilizing rests 212 to substantially stabilize the collar-retention frame 21 in position, the stabilizing rests 212 has most of the weight 9 of the supporting unit 20, such that when the wireless head set 20 is being worn on the user, the weight 9 of the head set 20 is on the stabilizing rests 212 such that the wireless head set 20 would lean stably on the user's collar area. This would in turn, stabilize the two headphone member 23.

Figure 3:
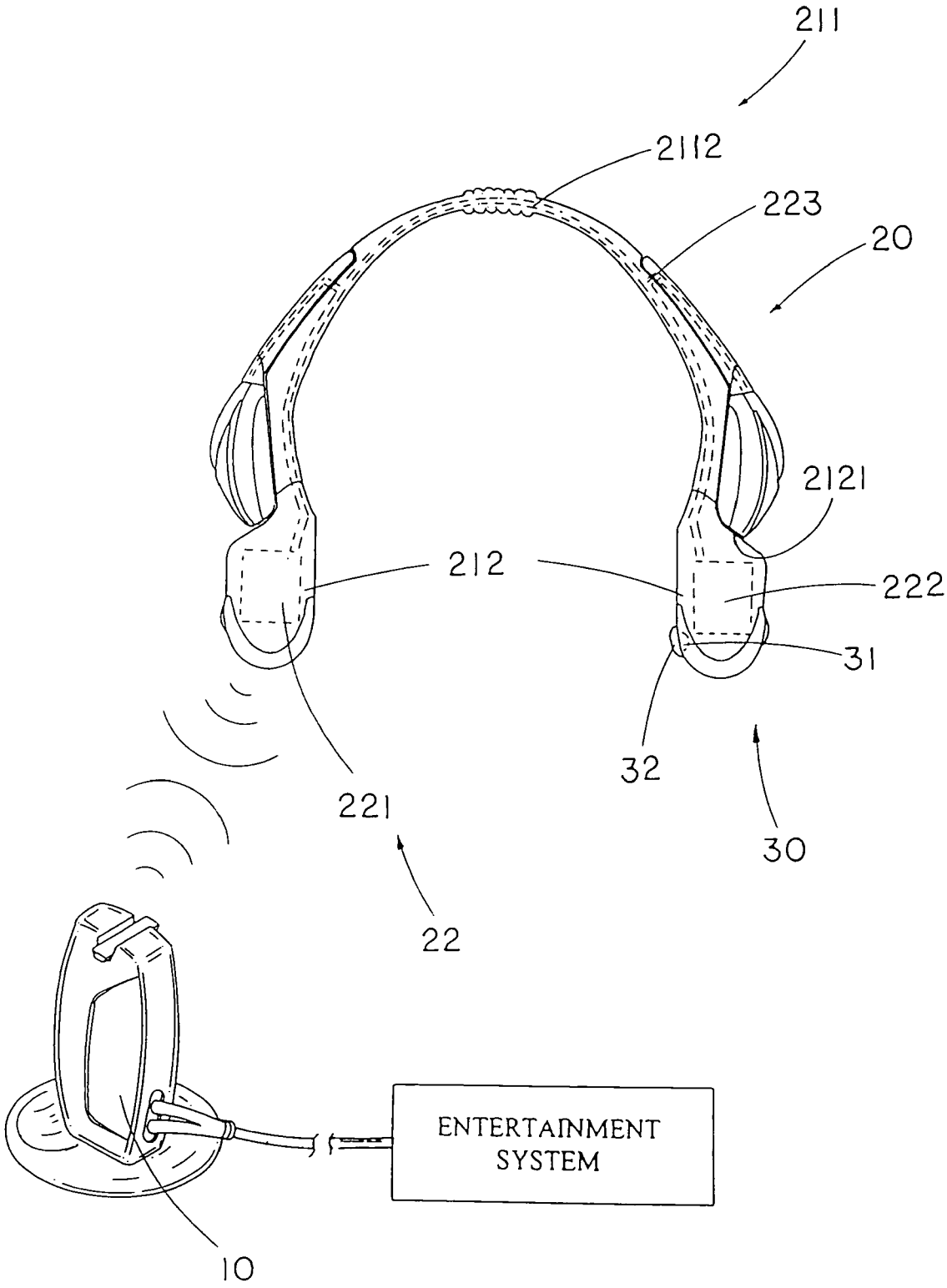
FIG. 3 is a perspective view of the audio communication head set according to the above preferred embodiment of the present invention

According to FIG. 3 of the drawings, the wireless receiving device 22 comprises a power source 221 and a wireless transceiver 222. The power source 221 and the wireless transceiver 222 are received in one of the stabilizing rests 212 respectively.

The wireless transceiver 222 is provided for wirelessly receiving the audio signal from the wireless transmitter 10, such that the audio signal from the entertainment system is transmitted to the wireless head set 20. And, the power source 221 is electrically connected with the wireless transceiver 222, providing power to the wireless transceiver 222.

According to the preferred embodiment of the present invention, since the audio communication head set is designed to be a wireless device, the power source 221 is a replaceable or rechargeable battery.

The wireless transceiver 222 can be an infrared signal receiver, which is provided for receiving the audio signal in form of infrared signal from the wireless transmitter 10. However, the wireless transceiver 222 can also be a RF (radio frequency) signal receiver.

Referring to FIG. 1 and FIG. 2 of the drawings, each of the two headphone members 23 comprises an ear piece 231 and an elongated extension 232. Each of the ear pieces 231 is provided for transmitting the audio signal from the wireless transceiver 222 into an audio form. Each of the elongated extensions 232 extends from the collar-retention frame 21 to the ear pieces 231 respectively allowing the ear pieces 231 to be adjusted to reach the vicinity of the user's ears.

As can be seen, users are allowed to freely adjust the elongated extensions 232, such that the audio communication head set can comfortably fit on him/her. At the same time, the audio communication head set is a one-size-fits-all property, such that all users can use the same audio communication head set comfortably since it is adjustable to fit round the neck and collar, as well as adjustable to accommodate different users' with different neck height.

The entire design of the wireless head set is to allow the overall weight of the wireless head set 20 to be supported and distributed on the collar of the user so as to minimize stress on user's head when he/she wears the wireless head set 20 through the shifting of all weight and pressure of the head set away from the neck to the collar of the user, and avoid posting any potential neck problem to users.

Each of the elongated extensions 232 comprises a length-adjustable folding arm 2321. Each of the folding arms 2321 has a pivot end 2322 and an opposed end 2323, where the pivot end 2322 is pivotally connected to the collar-retention frame 21 and the opposed end 2323 extends to the respective ear piece 231.

The folding arms 2321 allow the ear pieces 231 to fold in vicinity of the user's ears respectively. As can be seen, since the folding angles 9 of the folding arms are adjustable, the user can easily adjust the folding arms 2321, so as to find the position of the ear pieces 231 he/she is most comfortable with.

Furthermore, in order to allow and accommodate head movements of the user, each of the folding arms 2321 has a predetermined flexibility, such that while the user moves around his/her head, the respective ear piece 231 are retained in vicinity of the user's ears.

As a result, despite the fact that, unlike conventional ear-bud type headphones, the ear pieces 231 are not inserted into the ears of the user, the user can still listen to the music through the ear pieces 231 while carrying out other activities. In other words, the user will not lose the ear pieces 231 even when he/she moves his/her head around.

The length-adjustable feature of the folding arms 2321 is provided for accommodating different users of different head sizes and neck heights, such that the length of the folding arms 2321 can be extended and retracted to fit all users, so as to achieve a one-size-fit-all objective.

It is worth mentioning that when the folding arms 2321 are not in use, they are folded close to the collar-retention frame 211 in a storing position, such the folding arms 2321 are aligned with the collar-retention frame 211 respectively in such a manner that the folding arms 2321 do not become obstacles that might get caught by things and get damaged.

Each of the stabilizing rests 212 has a holding cavity 2121 indently formed on an outer side of the stabilizing rest 212 so as to hold the respective ear piece 231 in position when the respective folding arm 2321 is downwardly folded to overlap onto the collar-retention frame 21.

The holding cavity 2121 provides protection to the ear pieces 231 when the audio communication head set is not in use by holding the ear pieces 231 in position so as to hide them from dirt, water, collision and so forth, such that the ear pieces 231, as well as the audio communication head set, will have a longer lifespan.

It is also worth mentioning that the material of the wireless headset 20 is flexible and bendable, such as plastic, and titanium, such that the head set is more durable and easily adjustable.

Referring to FIG. 3 of the drawings, in order to transmit the audio signal from the wireless transceiver 222 to the ear pieces 231, the wireless receiving device 22 further comprises a signal cable 223 electrically extended from the wireless transceiver 222 to the ear pieces 231. According to the preferred embodiment of the present invention, the signal cable 223 goes through interiors 2112 of the collar-retention frame 211 and the folding arms 2321 in a hidden manner, such that the signal cable 223 cannot easily tempered with or damaged by getting caught by objects placed within the close proximity of the audio communication head set, such that the audio communication head set is well protected and more durable.

Figure 4:
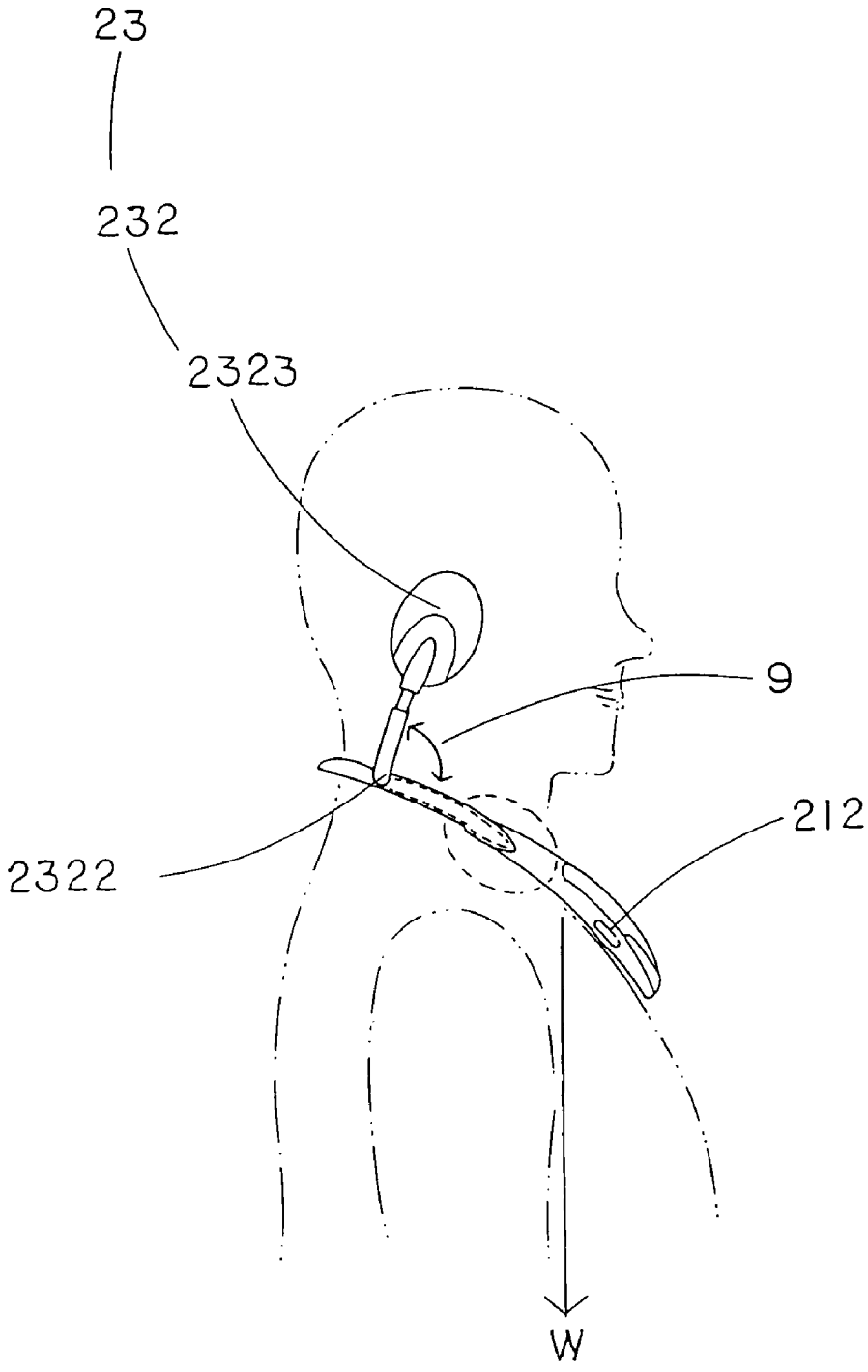
FIG. 4 illustrates an audio communication head set according to an alternative embodiment of the present invention.

According to FIG. 3 and FIG. 4 of the drawings, in order to allow a user the highest degree of freedom when using the audio communication head set for the entertainment system, the entertainment system can be voice activated, wherein the audio communication head set further comprises a vocal controller 30 which comprises a voice recognition device 31 and a microphone 32.

The voice recognition device 31 is provided for operating the entertainment system and is electrically connected to the wireless transmitter 10. The microphone 32 is electrically connected to the wireless transceiver 222 and supported by the one of the stabilizing rests 212.

The voice control 30 operates in such a manner that when the voice recognition device 31 receives a vocal command through the microphone 32 in a wireless manner, the voice recognition device 31 will operate the entertainment system with respect to the vocal command. The user can control the entertainment system through the voice control 30 to, and not limited to, operate, stop, increase and decrease in volume, select tracts, fast forward, rewind and so forth.

The user can control the loudness and other sound effects of the entertainment system by means of the voice control 30, as oppose to conventional audio communication head set where the volume and sound effect control are located on the entertainment system, such that the user has to reach for the entertainment system itself to change the volume and other sound effects.

As result, the user is free to move around the room, with the weight 9 of the wireless head set 20 comfortably resting on the collar bone area of the user, and sit in a comfortable spot which is not necessarily close to the entertainment system. Upon receipt of the command from voice control 30, the entertainment system would act accordingly.

It is worth mentioning that the voice control 30 is of a very light weight, such that no substantial amount of weight will be added to the wireless head set 20, such that it can be placed within either one of the headphone members 23 and at the same time avoiding the causing of any discomfort to the user due to an imbalance of stress posted on the user, and avoid potential physical problems.

Figure 5:
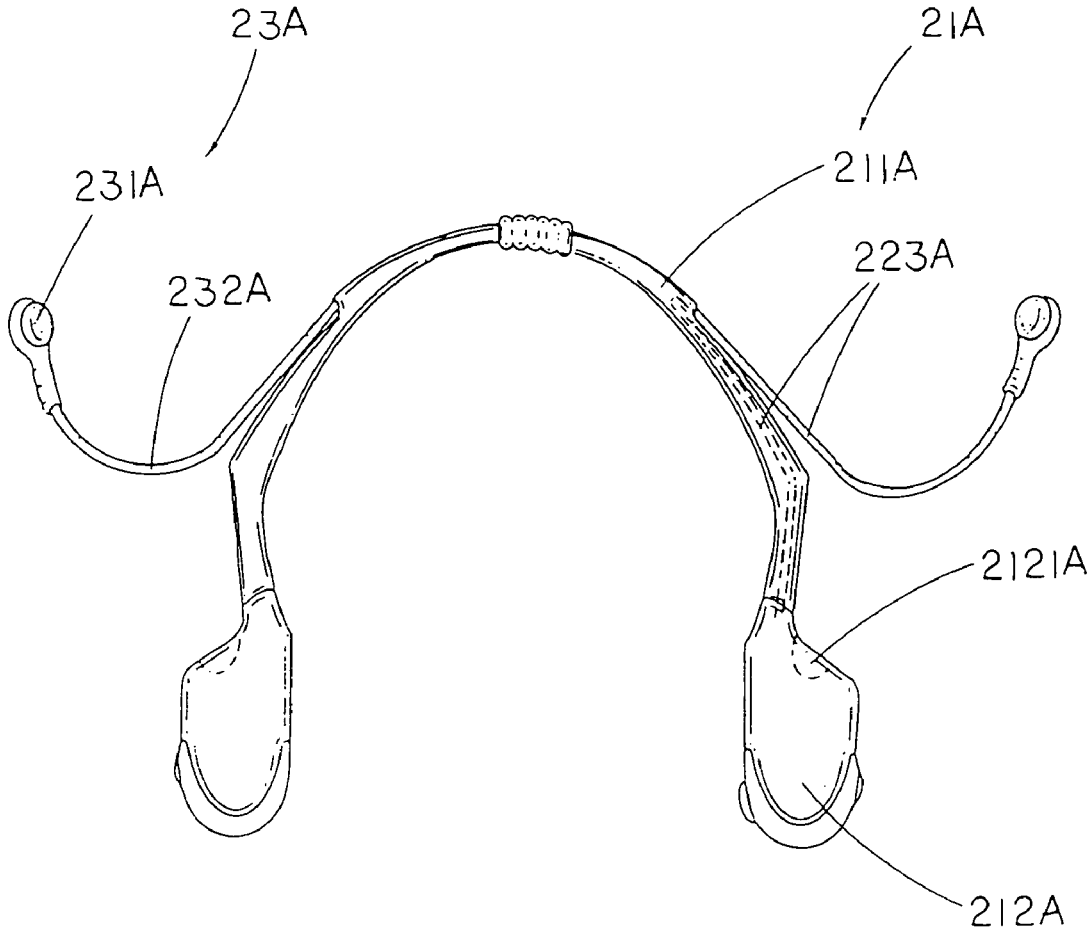
FIG. 5 illustrates the audio communication head set according to the above preferred embodiment of the present invention being in use.

Alternatively, referring to FIG. 5 of the drawings, each the two headphone members 23A comprises an ear piece 231A and an extension 232A. The pair of ear piece 231' is connected to the collar-retention frame 211A through the signal cable 223A, wherein the signal cable 223A are long enough to reach the ears of most users.

In order to protect the pair of ear piece 231A when the audio communication head set is not in a storage position, the collar-retention frame 211A has a holding cavity 2121A, wherein the user can tuck the pair of ear piece 231A into the holding cavity 2121A when the head set is not in used so as to prevent the ear pieces 231A from being damaged by things put along side of the head set.

Referring to FIGS. 6 to 9 of the drawings, a shoulder/neck supporting electronic appliance according to a preferred embodiment of the present invention is illustrated, wherein the shoulder/neck supporting electronic appliance is adapted for audio signal transmission. The example below illustrates the shoulder/neck supporting electronic appliance communicatively linked to an entertainment system for wirelessly receiving an audio signal from the entertainment system and transmitting the audio signal to a user.

The electronic appliance comprises a wireless transmitter 10', and a wireless head set 20'. The wireless transmitter 10' is adapted to communicatively connecting with an audio system to obtain an audio signal, and then modulate this audio signal into transmitting signal and transmit it. The wireless head set 20' will then receive this transmitted signal, demodulate this signal back to audio signal and transmit to user's ear.

Figure 6:
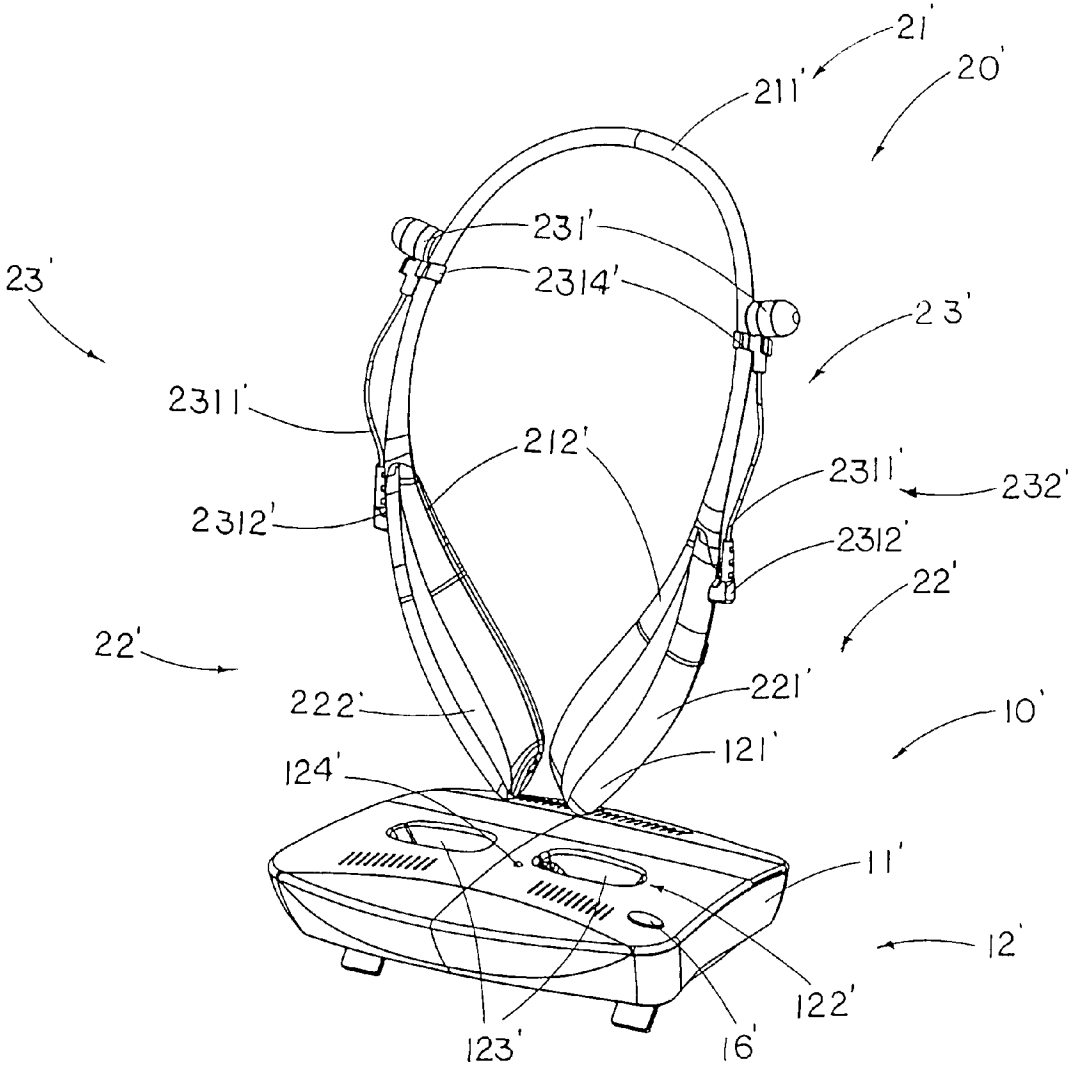
FIG. 6 is a perspective view of the shoulder/neck supporting electronic appliance.
Figure 7:
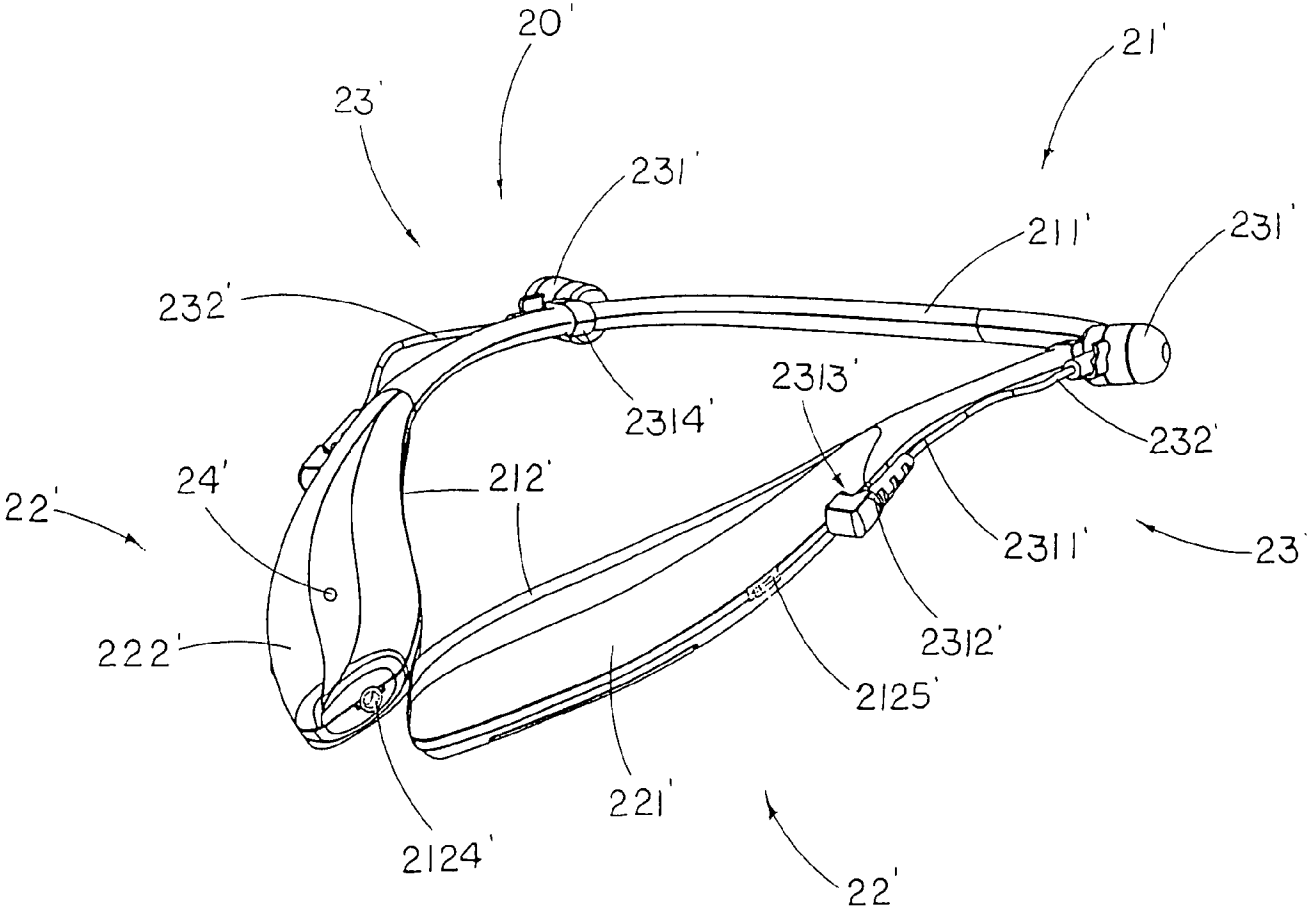
FIG. 7 is a perspective view of the wireless head set.
Figure 8:
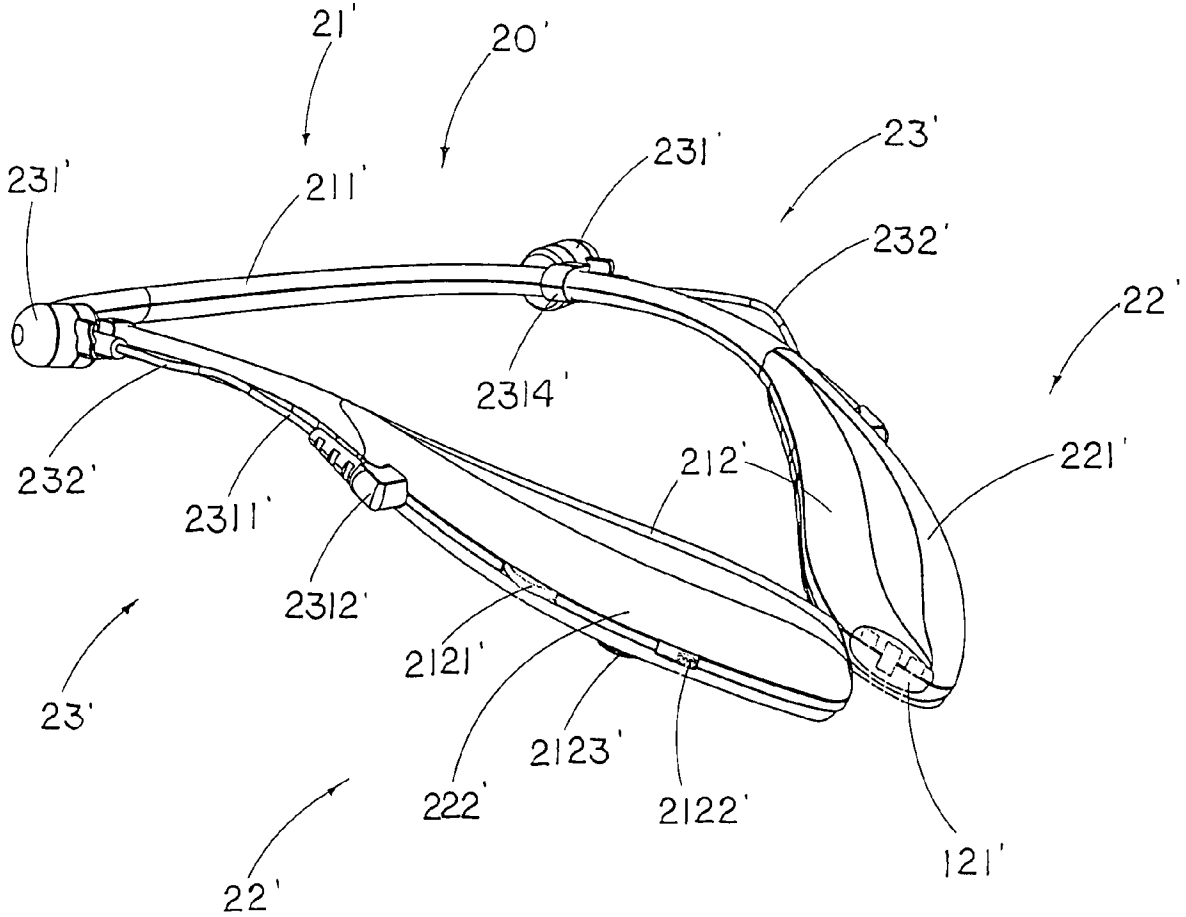
FIG. 8 is a perspective view of the wireless head set.

Referring to FIGS. 6 to 8, the wireless head set 20' comprises a supporting unit 21' adapted for wearing on a user's collar from behind, a wireless audio device 22', and a headphone member 23'.

The wireless audio device 22' comprises a wireless transceiver 222' supported by the supporting unit 21' for receiving an audio signal, and a power source 221' electrically coupled with the wireless transceiver 222'.

The headphone member 23' is provided at the supporting unit 21' in vicinity of the user's ear, such that an overall weight of the wireless head set 20' is adapted for being supported and distributed on the collar of the user to minimize stress on the user's head when the user's wears the wireless head set 20'.

The supporting unit 21' comprises a C-shaped collar-retention frame 211' adapted for wearing on a user's collar from behind, and two stabilizing rests 212' provided at two ends of the collar-retention frame 211' respectively for resting on the user's body to substantially stabilize the collar-retention arm in position. As mentioned before, the C-shape collar-retention frame 211' is provided for fitting around the neck area of a user and resting upon a collar bone area of a user. The material of the C-shaped collar-retention frame 211' is flexible. The curvature of the frame can be adjusted to make different users feel comfortable. The two stabilizing rests 212' contain the most elements and the weight of the headset and move the weight point into the front, so the whole head set can rest over the collar born.

The power source 221' is received in one of the stabilizing rests 212' and the wireless transceiver 222' is received in another said stabilizing rest 212' to electrically connect with the power source 221'. In a preferred embodiment of the present invention, the power source 221' is a rechargeable battery. In an alternative embodiment, the power source 221' is regular battery.

The wireless transceiver 222' receives signals transmitter by particular transmitter through predetermined medium. This medium could by IR, RF "Wifi" or "Bluetooth" wireless signal. When the wireless transceiver 222' receives the signal, it demodulates the signal into electrical signals and transmits the electrical signals to the headphone member 23' though a signal cable 2221'. The signal cable 2221' is embedded inside the collar-retention frame 211', so it won't affect the wearability of the electronic appliance.

The headphone member 23' of the wireless head set 20' is provided at the supporting unit 21' in vicinity of the user's ear. In this manner the overall weight of the wireless head set 20' is distributed on the collar of the user to minimize stress on user's head when the user's wears the wireless head set 20'. The headphone member 23' comprises two ear pieces 231', and two elongated extensions 232'.

In a preferred embodiment of the present invention, the two ear pieces 231', which are two earbuds which can be inserted into ears for listening, are extended from the elongated extensions 232'. Each of the elongated extensions 232' comprises an elongated cable 2311' electrically connected with the wireless transceiver 222' to transmit the electrical signal from the wireless transceiver 222'. In an embodiment of the present invention, each elongated cable 2311' has a plug 2312' which can plug into an outlet 2313' provided by the supporting unit 21' on the relative side. These two outlets 2313' are electrically connected with the elongated extensions 232'. In the way the ear pieces 231' can be removably coupled with the supporting unit 21' to receive electrical signals. Because the elongated cable 2311' of the ear pieces 231' are flexible and has a suitable length, the user can move his head freely when wearing the shoulder/neck supporting electronic appliance with the ear pieces 231' in ears. Each ear piece 231' also has a retainer 2314', when the ear pieces 231' are not used, they can be retained onto the collar-retention frame 211'.

In an alternative embodiment, the headphone members 23' also comprises two build in speakers 233' contained by the stabilizing rests 212'. In this manner, no elements will touch onto the user's ears. The user can feel more comfortable. Since the speakers 233' are very close to the user's ears, the volume can be controlled low enough in order to avoid disturbing others.

Referring to FIGS. 7 and 8, one of the stabilizing rests 212' contains the wireless transceiver 222', and also has a volume control 2121', a tone control 2122', and a balance switch 2123' which can control the volume, the tone, and the balance of the voice signal transmitted by the headphone members 23'. At the bottom of the stabilizing rest 212' is an audio jack 2124', the audio jack 2124' is electrically connected with the wireless transceiver 222' and can be coupled with other external headphone device to transmit electrical signals demodulated by the wireless transceiver 222'. The other stabilizing rest 212' contains the battery, and also has a power switch 2125' for turning on and off the device, and the charging terminal which is electrically connected with the rechargeable battery.

In the embodiment, the wireless head set 20' comprises a microphone 24' which can sense the user's vocal commands and realize voice control. Accordingly, the microphone 24' is communicatively linked to the wireless transceiver 222' and is provided at the supporting unit 21' in vicinity of the user's mouth when the supporting unit 21' is worn, wherein said wireless transceiver 222' is adapted for wirelessly transmitting a vocal signal received from the vocal signal. Therefore, the wireless head set 20' is adapted to transmit the vocal signal as control signal to the audio system. In this manner the user can do remote control, for example, control the TV set for changing channels. Likewise, the wireless head set 20' can be a hearing aid for a person who is hard of hearing, wherein the person is able to wear the wireless heat set 20' to gather the sound by the microphone 24' and to transmit to the ear of the person. The user is able to use the wireless head set 20' of the present invention as a microphone set of the computer or telephone for communication.

Figure 9:
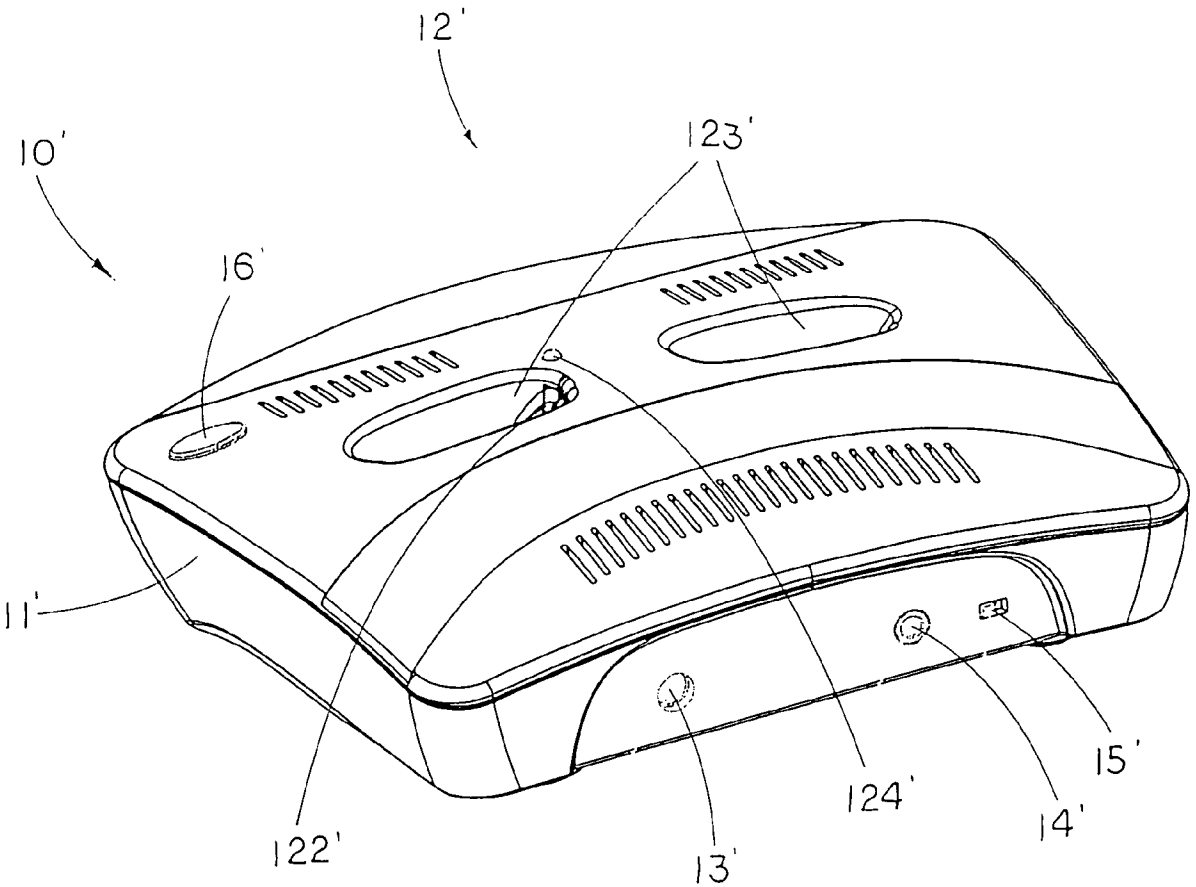
FIG. 9 is a perspective view of the wireless transmitter.

Referring to FIG. 9, the wireless transmitter 10' obtains audio signal from the audio system, and transmits the audio signal to the wireless head set 20' wirelessly. In a preferred embodiment, the wireless transmitter 10' has a container 11'. The container receives all the elements of the wireless transmitter 10' and can be placed on a flat surface stably. The wireless transmitter 10' has a DC jack 13', an audio jack 14', a stereo/mono switch 15', and a power indicator 16'. The DC jack 13' can be couple with power outlet through a power for device power supply. The audio jack 14' is electrically connected with the wireless transmitter 10'. When it is coupled with the audio output of the audio system, the wireless transmitter 10' can receive the audio signal. The stereo/mono switch 15' can control the output signal of the wireless transmitter 10' between stereo and mono. The power indicator indicates 16' the power status of the wireless transmitter 10'.

The wireless transmitter 10' and the wireless head set 20' are communicating through infrared (IR), radio frequency (RF), "Wifi", or "Bluetooth". In an alternative embodiment of the present invention, the transmission is through IR. FIGS. 12 and 13 illustrate the block diagram of the circuit for the transmission.

Figure 10:
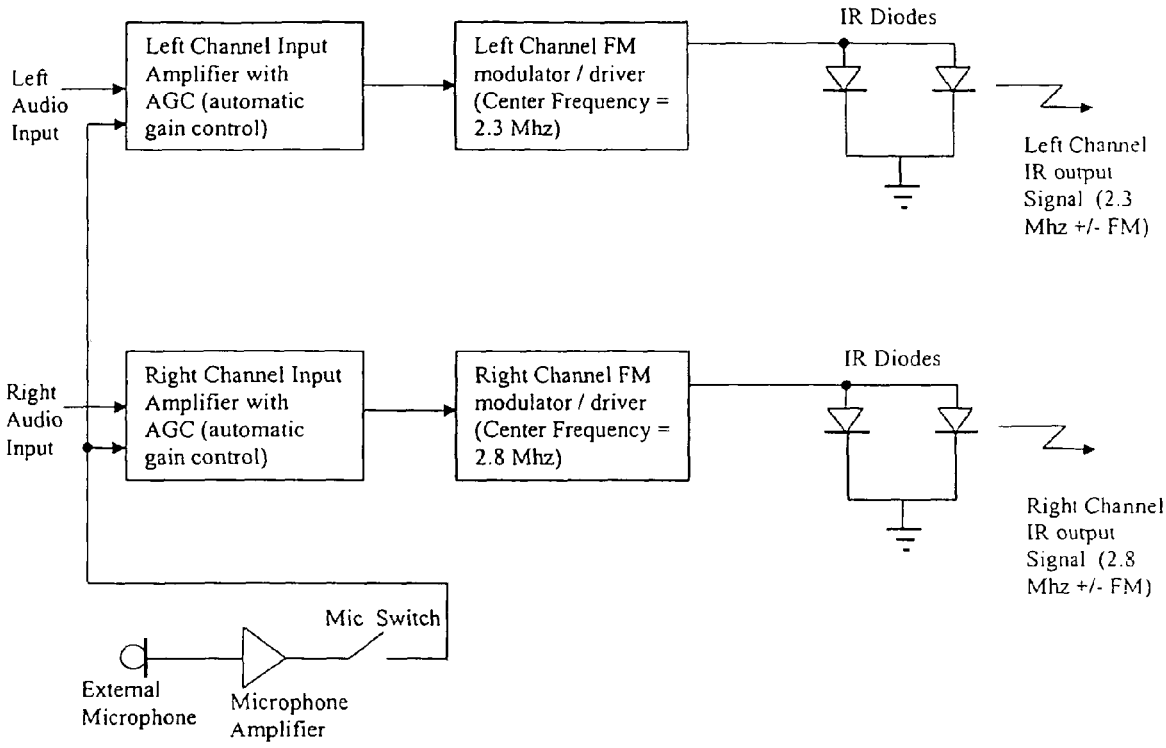
FIG. 10 is a block diagram of the wireless transmitter.

FIG. 10 illustrates the block diagram of the transmitter. If the original sound signal is stereo, the left sound signal and the right sound signal are input into the left and right channel input amplifier with automatic gain control (AGC) respectively. If the original sound signal is mono, for example, from an external microphone, the same signal will input into the two channels. Then the amplified signals are modulated by the left and right FM modulator/driver. The center frequency of the left channel is 2.3 MHz, the center frequency of the right channel is 2.8 MHz. The modulated signals then drive two IR diodes to general IR signals for transmission.

Figure 11:
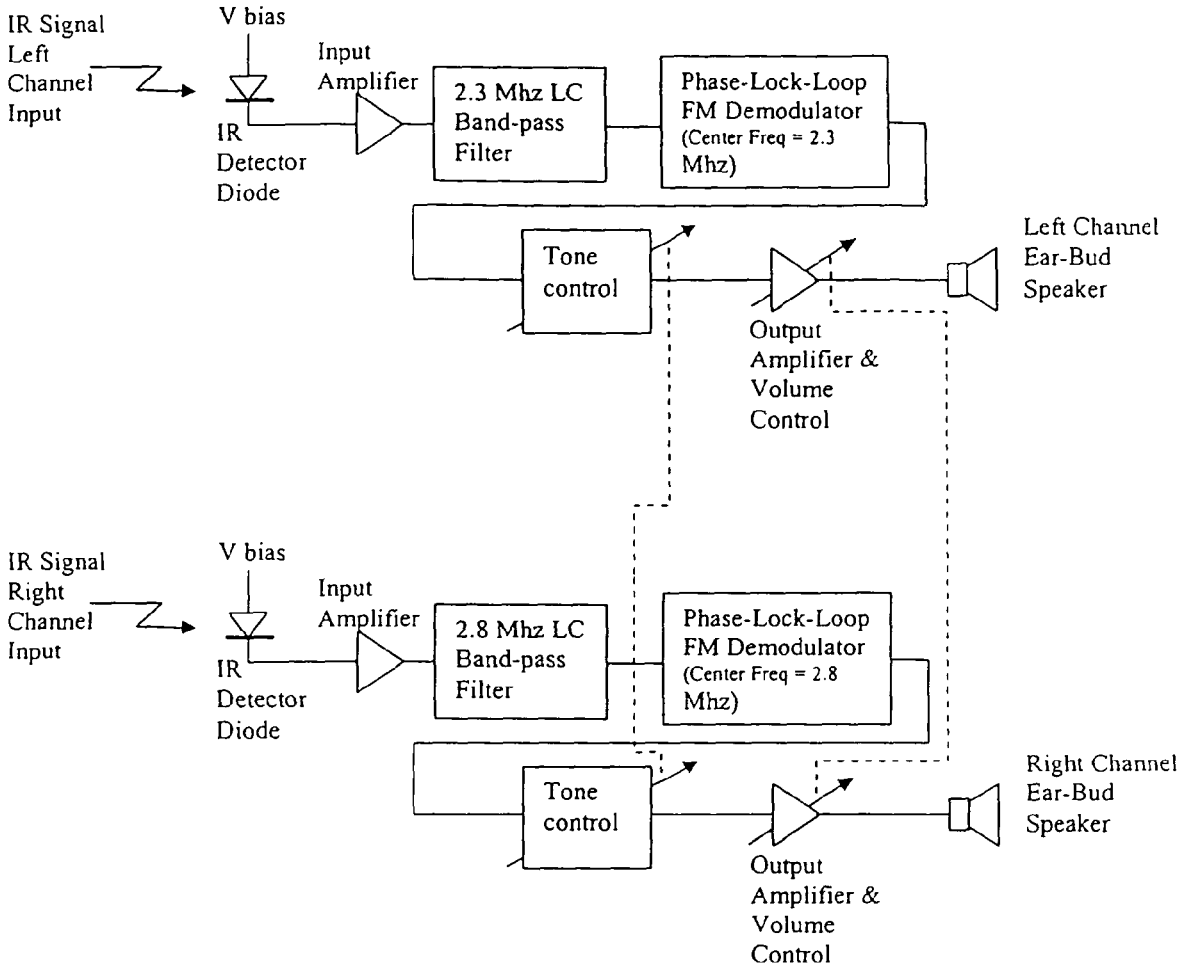
FIG. 11 is a block diagram of the wireless head set.

FIG. 11 illustrates the block diagram of the receiver. Each channel has a receiver on the wireless headset. The receiver includes an IR detector diode which detects the IR signal and transforms the IR signal into electronic signal. This electronic signal is then amplified by an input amplifier and then input into a band-pass filter to pick the right signal of this channel. The left channel is using 2.3 MHz LC band-pass filter, and the right channel is using 2.8 MHz LC band-pass filter. Then the right frequency of the filtered signal is demodulated by a Phase-Lock-Loop FM demodulator. The two channels have 2.3 MHz and 2.8 MHz as the central frequencies respectively. After demodulation, the signal is further processed by a tone control and a volume control. Then the electronic signal will drive the relative ear-bud speaker to produce sound. The tone control and the volume control are controlling the left and right channels together.

The wireless transmitter 10' has multiple functions. Referring the FIG. 9, the wireless transmitter 10' also comprises a self charging unit 12' for charging the rechargeable battery of the wireless head set 20'. The self charging unit 12' has a charging terminal 121', a charging station 122' and two retention seats 123'. The charging terminal 121' is electrically connected with the rechargeable battery and located in the stabilizing rest 212' where the rechargeable battery is received. The charging station 122' is provided at one of the retention seats 123' to electrically couple with the charging terminal 121' when the ends of the supporting unit 21' are rested at the retention seats 123' respectively. The electrodes of the charging terminal 121' are exposed from the stabilizing rest 212' so they can be coupled with the charging station 122' to form a charging circuit. Referring the FIG. 11, the wireless transmitter 10' provides two cavities on the top surface according to the dimension of the stabilizing rests 212' as the retention seats 123'. When the wireless head set 20' is not used, the stabilizing rests 212' can be put onto the retention seats 123' and be retained by the two relative cavities. One of the retention seats 123' contains the charging station 122' of the charging unit. When the relative stabilizing rest 212' which contains the charging terminal 121' is rest on the retention seat 123', the charging station 122' is coupled with the charging terminal 121'. At this manner, the charging circuit is formed, and the charging unit starts to charge the rechargeable battery. The transmitter also comprises a charging indication 124' indication the charging status.

In summary, the shoulder/neck supporting electronic appliance of the present invention can be applied in many purposes. The wireless transmitter 10' can obtain voice signal from a wide range of devices such as TV set, CD player, DVD player, computer, and microphone. Then the wireless transmitter 10' transmits the signal to the wireless head set 20' so the user can hear the voice without using a cable to connect with the voice system. Alternatively, if the voice system itself has a wireless signal transmitter, the wireless head set 20' can directly receive it. For example, the wireless head set 20' can receive the signal from a wireless microphone. This is will be helpful for people with hearing obstacle.

The wireless head set 20' receives the transmitted signal and produce the voice through the headphone members 23'. The headphone members 23' can be ear pieces 231', headphone, or build in speakers for the user's convenient. The head set can also be connected with external devices to produce sound through an outlet. The wireless head set 20' can also have remote control functions. By control buttons or voice control, the wireless head set 20' can transmit control signals to the voice system for desired performance.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A shoulder/neck supporting electronic appliance, comprising a wireless head set which comprises:

a supporting unit adapted for wearing on a user's collar from behind;

a wireless audio device comprising a wireless transceiver supported by said supporting unit for receiving an audio signal, and a power source electrically coupled with said wireless transceiver; and a headphone member provided at said supporting unit in vicinity of said user's ear, such that an overall weight of said wireless head set is adapted for being supported and distributed on said collar of said user to minimize stress on said user's head when said user's wears said wireless head set, wherein said supporting unit comprises a C-shaped collar-retention frame adapted for wearing on a user's collar from behind, and two stabilizing rests provided at two ends of said collar-retention frame respectively for resting on said user's body to substantially stabilize said collar-retention frame in position.

2. The shoulder/neck supporting electronic appliance, as recited in claim 1, wherein said power source and said wireless transceiver are received in said stabilizing rest respectively at a position that said power source are electrically connected to said wireless transceiver through said collar-retention frame.

3. The shoulder/neck supporting electronic appliance, as recited in claim 2, wherein said headphone member comprises two elongated extensions spacedly extended from said supporting unit to communicate with said wireless transceiver, and two ear pieces extended from said elongated extensions respectively for transmitting said audio signal from said wireless transceiver into an audio form, such that said ear pieces are adapted for being selectively moved in vicinity of said user's ears respectively.

4. The shoulder/neck supporting electronic appliance, as recited in claim 3, further comprising a self-charging unit for electrically charging said power source, wherein said self-charging unit comprises a charging terminal provided to contact an opposing charging terminal at one end of said support unit, and a charging station arranged in such a manner that when said wireless head set is seated on said self-charging unit to electrically couple said charging terminal with said charging station, said power source is automatically charged.

5. The shoulder/neck supporting electronic appliance, as recited in claim 4, wherein said charging station comprises two spaced apart retention seats to hold two ends of said supporting unit in position, wherein said charging station provided at one of said retention seats such that when said ends of said supporting unit are rested at said retention seats respectively, said charging terminal is electrically contacted with said charging station to charge said power source.

6. The shoulder/neck supporting electronic appliance, as recited in claim 4, wherein said wireless audio device further comprises a microphone which is communicatively linked to said wireless transceiver and is provided at said supporting unit in vicinity of said user's mouth when said supporting unit is worn, wherein said wireless transceiver is adapted for wirelessly transmitting a vocal signal received from said vocal signal.

7. The shoulder/neck supporting electronic appliance, as recited in claim 5, wherein said collar-retention frame is made of flexible material that said collar-retention frame has an adjustable curvature for naturally being worn on said user's collar from behind.

8. The shoulder/neck supporting electronic appliance, as recited in claim 5, wherein said wireless audio device further comprises a microphone which is communicatively linked to said wireless transceiver and is provided at said supporting unit in vicinity of said user's mouth when said supporting unit is worn, wherein said wireless transceiver is adapted for wirelessly transmitting a vocal signal received from said vocal signal.

9. The shoulder/neck supporting electronic appliance, as recited in claim 7, wherein said wireless audio device further comprises a microphone which is communicatively linked to said wireless transceiver and is provided at said supporting unit in vicinity of said user's mouth when said supporting unit is worn, wherein said wireless transceiver is adapted for wirelessly transmitting a vocal signal received from said vocal signal.

10. The shoulder/neck supporting electronic appliance, as recited in claim 7, further comprising a wireless transmitter adapted for communicatively connecting with an audio system to obtain said audio signal therefrom, wherein said wireless transmitter is wirelessly connected with said wireless transceiver to wirelessly transmit said audio signal between said wireless transmitter and said wireless head set.

11. The shoulder/neck supporting electronic appliance, as recited in claim 9, further comprising a wireless transmitter adapted for communicatively connecting with an audio system to obtain said audio signal therefrom, wherein said wireless transmitter is wirelessly connected with said wireless transceiver to wirelessly transmit said audio signal between said wireless transmitter and said wireless head set.

12. The shoulder/neck supporting electronic appliance, as recited in claim 9, wherein said wireless transceiver is a wireless device wirelessly transmitting said audio signal in form of wireless signal selected from a group consisting of RF (radio frequency) signal, infrared signal, "Wifi" signal, and "Bluetooth" signal.

13. The shoulder/neck supporting electronic appliance, as recited in claim 11, wherein said wireless transceiver is a wireless device wirelessly transmitting said audio signal in form of wireless signal selected from a group consisting of RF (radio frequency) signal, infrared signal, "Wifi" signal, and "Bluetooth" signal.

14. The shoulder/neck supporting electronic appliance, as recited in claim 1, wherein said headphone member comprises two elongated extensions spacedly extended from said supporting unit to communicate with said wireless transceiver, and two ear pieces extended from said elongated extensions respectively for transmitting said audio signal from said wireless transceiver into an audio form, such that said ear pieces are adapted for being selectively moved in vicinity of said user's ears respectively.

15. The shoulder/neck supporting electronic appliance, as recited in claim 14, further comprising a self-charging unit for electrically charging said power source, wherein said self-charging unit comprises a charging terminal provided to contact an opposing charging terminal at one end of said support unit, and a charging station arranged in such a manner that when said wireless head set is seated on said self-charging unit to electrically couple said charging terminal with said charging station, said power source is automatically charged.

16. The shoulder/neck supporting electronic appliance, as recited in claim 15, wherein said charging station comprises two spaced apart retention seats to hold two ends of said supporting unit in position, wherein said charging station provided at one of said retention seats such that when said ends of said supporting unit are rested at said retention seats respectively, said charging terminal is electrically contacted with said charging station to charge said power source.

17. The shoulder/neck supporting electronic appliance, as recited in claim 16, wherein said collar-retention frame is made of flexible material that said collar-retention frame has an adjustable curvature for naturally being worn on said user's collar from behind.

* * * * *